US005491849A

United States Patent [19]

Colussi et al.

[11] Patent Number: 5,491,849

[45] Date of Patent: Feb. 20, 1996

[54] BATHTUB HAVING HANDLES ON WHICH TUB OPERATION ELEMENTS ARE MOUNTED

[75] Inventors: Lucio Colussi; Mario D'Andrea, both of Pordenone, Italy

[73] Assignee: Albatros System S.p.A., Pordenone, Italy

[21] Appl. No.: 309,190

[22] Filed: Sep. 20, 1994

[30] Foreign Application Priority Data

Sep. 22, 1993 [IT] Italy ..... PN93U0023

[51] Int. Cl.[6] ..... A47K 3/00

[52] U.S. Cl. ..... 4/559; 4/541.1

[58] Field of Search ..... 4/538, 541.1–541.5, 4/546, 559, 584

[56] References Cited

U.S. PATENT DOCUMENTS

| | | | |
|---|---|---|---|
| 4,346,485 | 8/1982 | Reed et al. | 4/538 X |
| 4,575,882 | 3/1986 | Diamond | 4/559 |
| 4,908,888 | 3/1990 | Watkins | 4/541.3 |
| 5,101,521 | 4/1992 | Levien | 4/541.5 X |

*Primary Examiner*—Charles E. Phillips

*Attorney, Agent, or Firm*—Wenderoth, Lind & Ponack

[57] ABSTRACT

A bathtub, in particular a whirlpool bath, includes a pair of handles for aiding one into and out of the tub body, and control and actuation elements, as well as water delivery elements mounted to the handles. These elements include an actuator for actuating the plug provided to stop up the drain, an actuator in the form of a control valve for mixing hot water with cold water so as to achieve a single flow of water at a desired temperature, a hand-shower, an actuator to divert water to an extractable nozzle of the hand-shower, a control element for starting and stopping the operation of a water circulating pump and an air blowing pump of the whirlpool bath, a plug of a reservoir for liquid disinfectant, and a switch to actuate a valve which admits the liquid disinfectant into a water circulation circuit of the tub. One of the handles which accommodates the extractable hand-shower also includes another water delivery element in the form of a water outlet through which water cascades into the tub body. The handles are provided at the two upper edges of the opposing longitudinal sides of the tub body. These handles each include a narrow portion sized to be seized by a user of the tub, and a second portion in the form of a housing having a wider profile to which the control, actuation and water delivery elements are mounted.

10 Claims, 5 Drawing Sheets

BATHTUB HAVING HANDLES ON WHICH TUB OPERATION ELEMENTS ARE MOUNTED

BACKGROUND OF THE INVENTION

This invention relates to an improvement in a bathtub such as a whirlpool bathtub, having tub operation elements including water delivery, control and actuation elements.

Bathtubs, in particular whirlpool tubs, are known to be provided with an inlet through which a cascading flow of water is introduced into the tub body, a drain, a hand-shower, and a number of functional control and actuation elements. More particularly, whirlpool tubs are conventionally provided with means (actuation element) for actuating the plug stopping up the drain, means (actuation element) for mixing hot water with cold water so as to achieve a single flow of water at a desired temperature, means (actuation element) for diverting the flow of water towards an extractable nozzle (water delivery element) of the hand-shower, means (control elements) for starting and stopping the operation of the water circulating pump and the air blowing pump, a plug for capping a reservoir to be filled with liquid disinfectant, and a switch (control element) for operating an electromechanical valve which allows the liquid disinfectant to enter the water circulation circuit of the tub.

All such water delivery, control and actuation elements are typically arranged either on the wall adjacent the tub or along the upper edges of the sides of the tub, in particular along the longitudinally extending sides of the latter.

However, this gives rise to the following drawbacks. The installation of the functional control and/or actuation elements directly on the surface of the tub body or the wall adjacent the tub body makes it necessary for the manufacturer to provide a large number of drillings in order to allow the elements to be inserted through the material of the tub body. This in turn requires a number of very delicate, highly accurate and, therefore, expensive manufacturing operations. Moreover, water-tightness must be restored around the spots where these elements protrude after their installation.

This is particularly true when the elements are arranged on the wall adjacent the bathtub, this making it in fact necessary to also perform some masonry work. Furthermore, normal or ordinary maintenance of the elements, as well as their repair or replacement, turn out to be quite complicated operations typically requiring the need for specialized professionals, such as masons, tilers and plumbers.

Another drawback derives from the fact that for such control and actuation elements to be easily actuated, they must be located in a zone which is normally occupied by handles grasped by the user for support and/or for guidance into or out of the tub.

It therefore happens that the elements are so concentrated in such a zone that the location of the handles makes their use less convenient or that it becomes more complicated to correctly operate or actuate the water delivery, functional control and/or actuation elements.

SUMMARY OF THE INVENTION

It is therefore an object of the present invention to provide a bathtub, in particular a whirlpool type of tub, which is free from the above-mentioned drawbacks, i.e. which does not require any complex operation or a typical technology for its manufacture or installation, whereby the tub can be manufactured and installed in a very cost-effective manner.

To achieve this object, the present invention provides two handles, which may be of different shapes, on the upper edges of the two long sides of the bathtub, the handles having profiles appropriate for accommodating the control, actuation and water delivery elements.

BRIEF DESCRIPTION OF THE DRAWINGS

The invention will be more clearly and readily understood from the following description of a non-limiting example made with reference to the accompanying drawings, in which.

DETAILED DESCRIPTION OF THE PREFERRED EMBODIMENT

Although the present invention will be described in the following as a whirlpool bathtub, it will be appreciated that the present invention is applicable to any more or less traditional type of bathtub.

Figure 1:
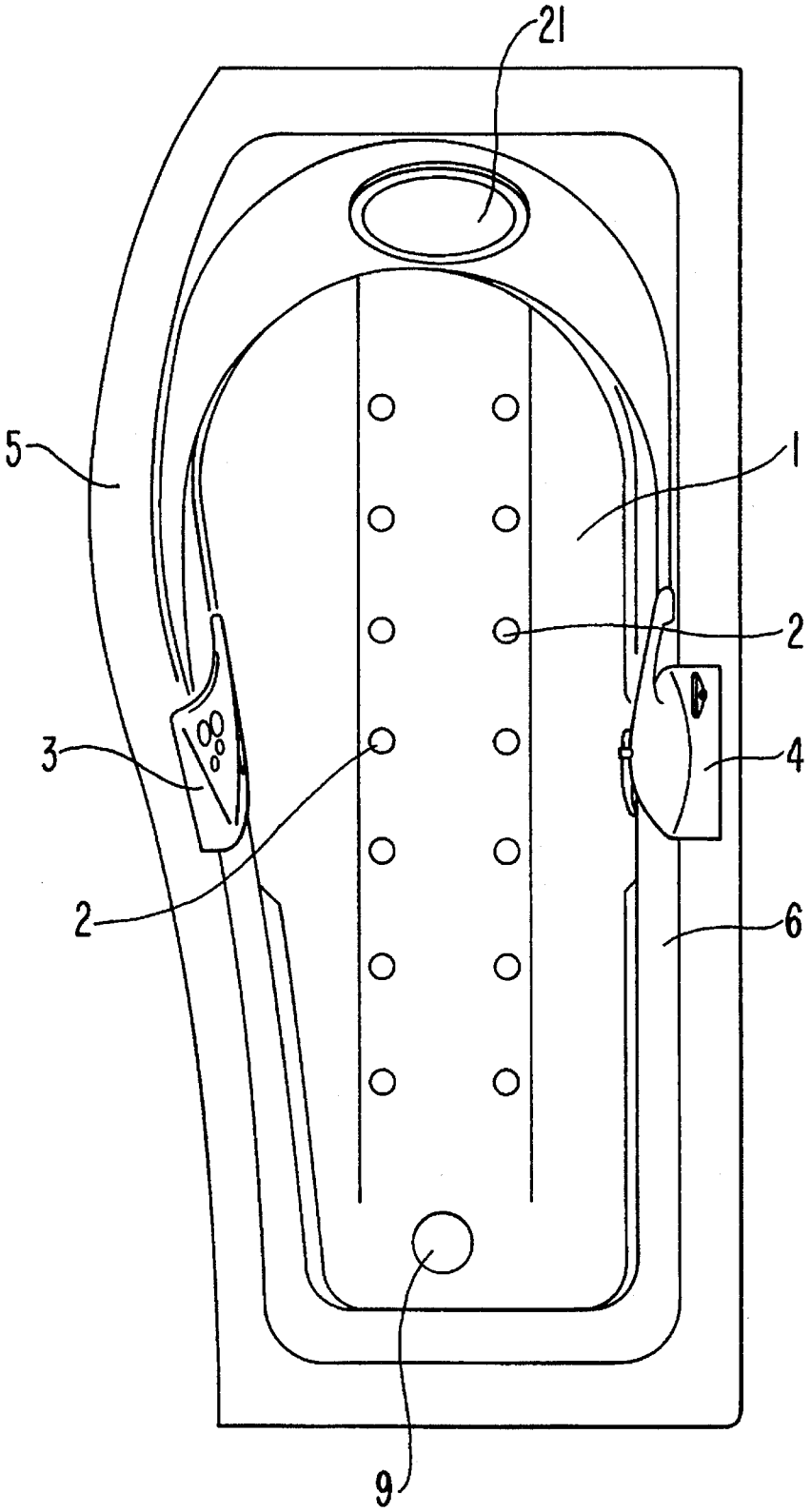
FIG. 1 is a top view of a bathtub according to the invention.

With reference to FIG. 1, a bathtub 1 has a plurality of holes 2 on the bottom thereof through which water is jetted. The bathtub also has two large handles 3, 4 situated on the two upper edges 5 and 6, respectively, of the mutually opposing long sides of the bathtub.

Figure 2:
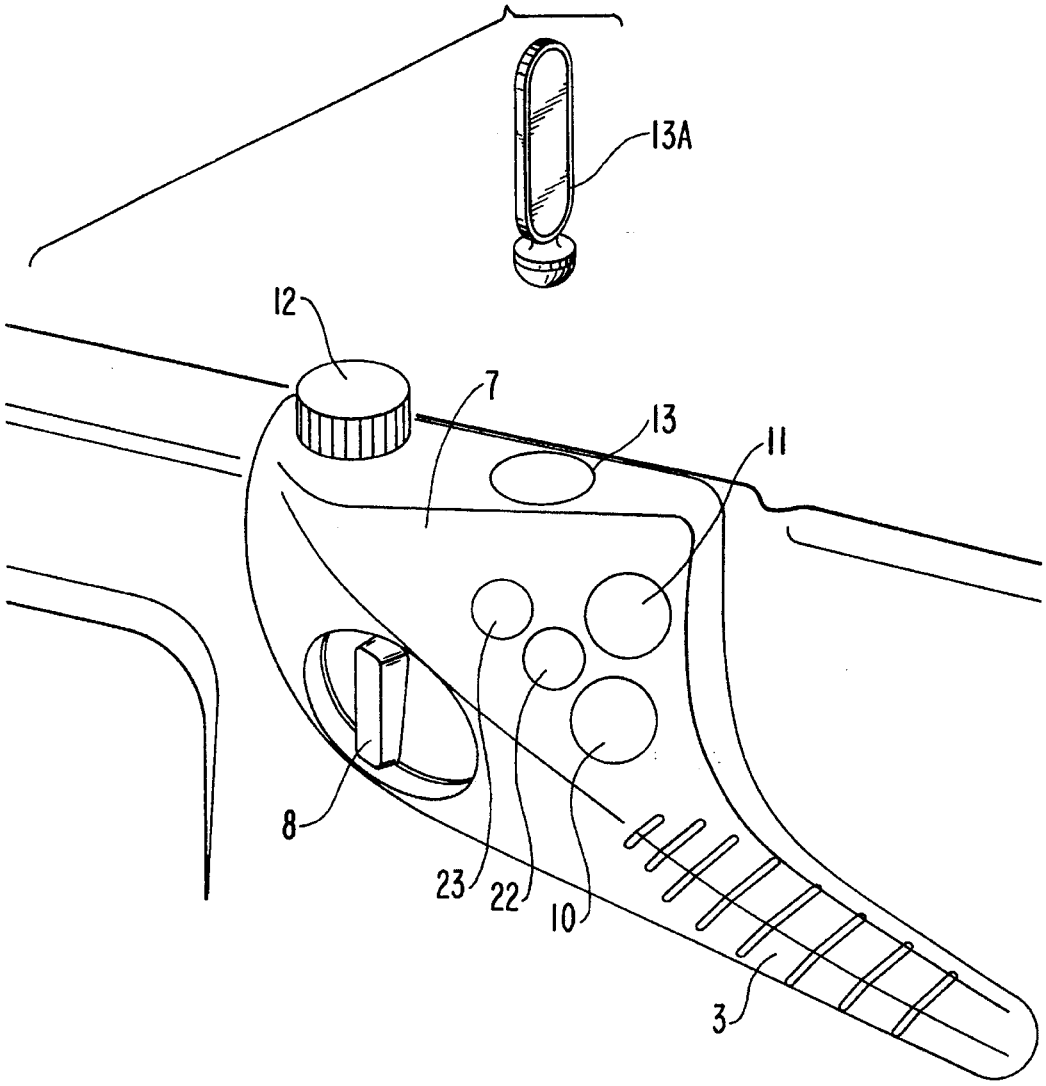
FIG. 2 is a perspective view of a first part of the bathtub.
Figure 3:
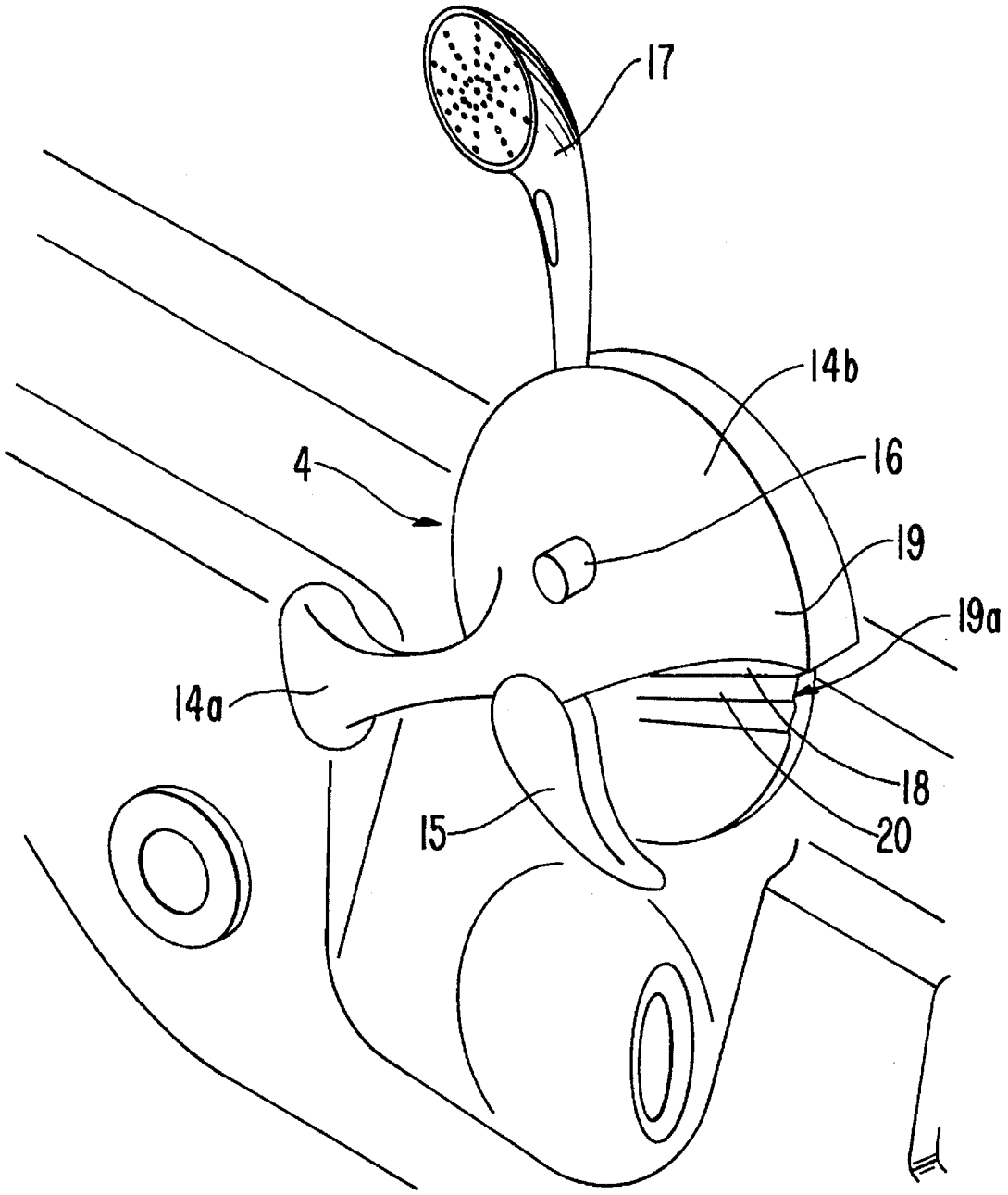
FIG. 3 is a perspective view of a second part of the same bathtub.

With particular reference to FIGS. 2 and 3, the first of these handles 3 is provided with a first narrow portion 7*a* which is easily grapped or seized by a user of the tub, and a housing in the form of a larger expanded portion 7*b* to which some of the tub operation elements, namely control and actuation elements, are mounted. These elements control the tub accessory elements and may include, for example, the element 8 for actuating a ratchet-type plug 9 used to stop up the drain of the tub, as well as the control elements, such push-buttons 10 and 11, for switching on and off the water circulating pump and the air blowing pump or "blower", respectively, of the tub.

The handle also comprises a cap 12 through which liquid disinfectant is introduced into a reservoir, from which the liquid is introduced into a water circulation circuit according to an appropriately timed sequence upon the actuation of a further control element 13 (to be described in more detail below) that is also situated on the same portion 7 of the first large handle 3.

Figure 6:
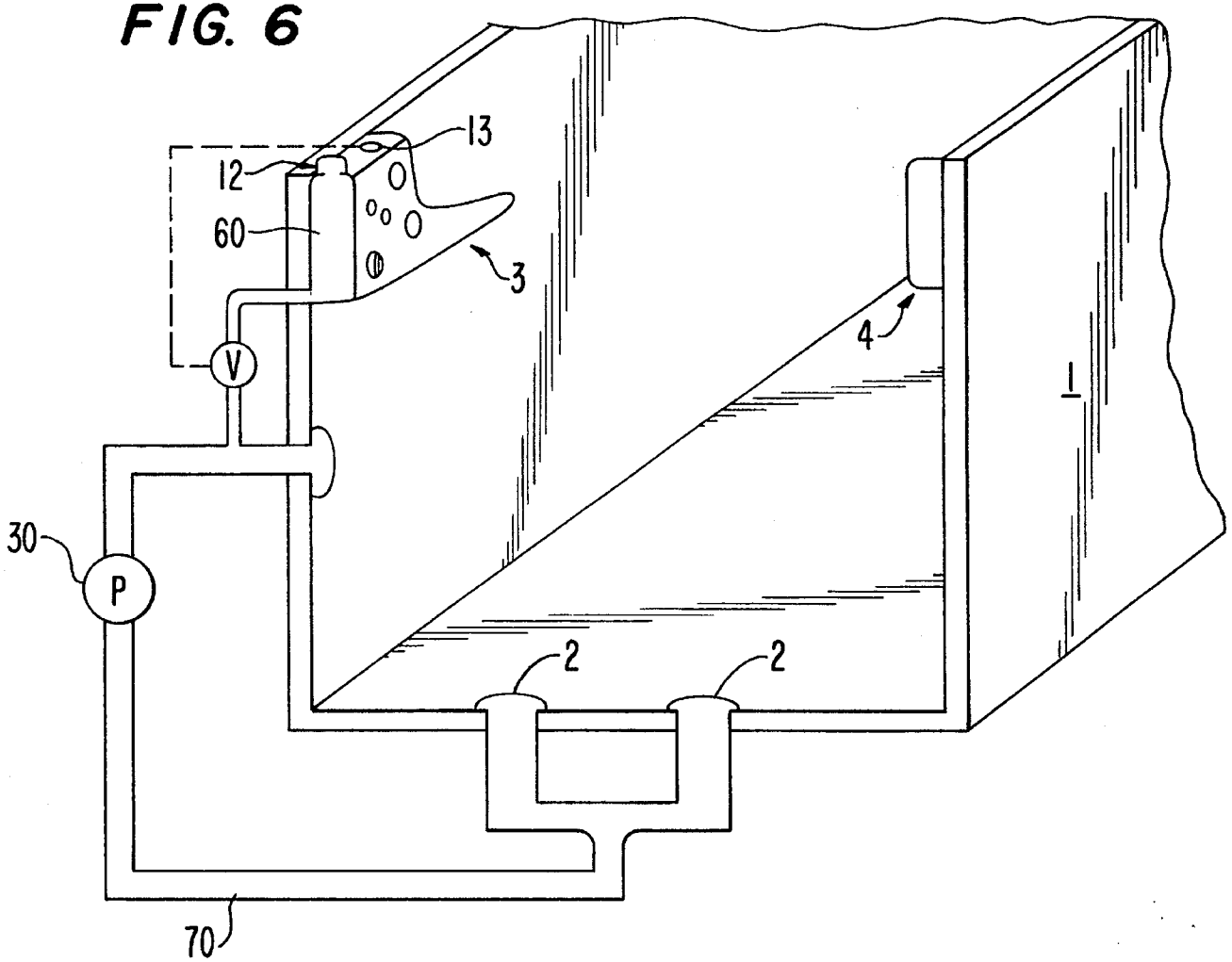
FIG. 6 is a schematic broken-away perspective view of the bathtub for use in illustrating a disinfecting operation.

Since the operation in which the liquid disinfectant is introduced into the water circulation circuit is preferably carried out when the bathtub is empty, i.e. after its use, the operation must be initiated using two distinct parts 13 and 13A in order to prevent the user from accidentally activating the control element when he or she is still immersed in the bath or in order to prevent such an element from being erroneously activated by, for instance, unattended children. For instance, the control element consists of a lock 13; and part 13A is a special key for "unlocking" or operating the lock 13 (control element). The key 13A may in turn comprise a magnetically operating key which is normally kept separately in an appropriate place. After using the bathtub, the user inserts the key 13A into the lock 13 and this causes the disinfection operation to automatically take place. Any known type of magnetic key and lock can be used for this purpose. Further, the disinfecting operation, known per se, comprises (refer to FIG. 6) opening a valve (or other suitable control element) for a predetermined time to let liquid disinfectant out of the reservoir 60 and into the water circulation circuit 70 and flushing both the circuit and the associated water circulation elements, such as water circulating pump 30, with water for a predetermined period of time.

Because the control element 13 and key 13A are used to control the valve, a convenient and easy activation of the disinfecting operation is ensured along with the provision of a safety feature, namely the impossibility of starting the disinfecting operation accidentally when the user is still in the bathtub or of having it started by other, unauthorized people.

Referring now to FIG. 3, the second large handle 4 also has a first narrow portion 14*a*, and a second larger expanded portion 14 in the form of a housing to which further tub operation elements are mounted, such as an actuator 15 in the form of a conventional valve for mixing hot water and cold water, and an actuator 16 in the form of a push-button for causing the flow of water to be diverted from an extractable hand-shower 17 to a cascade-type of free water outlet 18 (water delivery elements) and vice-versa.

In particular, the cascade-type of free water outlet 18 is defined by a space between two lips 19 and 20 which flank each other. A series of ridges 19*a* are formed by the handle 4 below the water outlet 18 so that the water flowing from the outlet 18 will cascade over the ridges 19*a*.

It is to be noted that the above-mentioned control and actuation elements are well-known, per se, to those of ordinary skill in the art and as such will not be described in detail for the sake of brevity.

The back wall of the tub is provided with an inflatable cushion 21. The control mechanism, such as a suitable valve 25, for causing the cushion to be inflated or deflated is activated by appropriate control elements 22 and 23, respectively, which are preferably in the form of push-buttons of a switch and are located on either of the large handles. See FIG. 2, for example.

Figure 4:
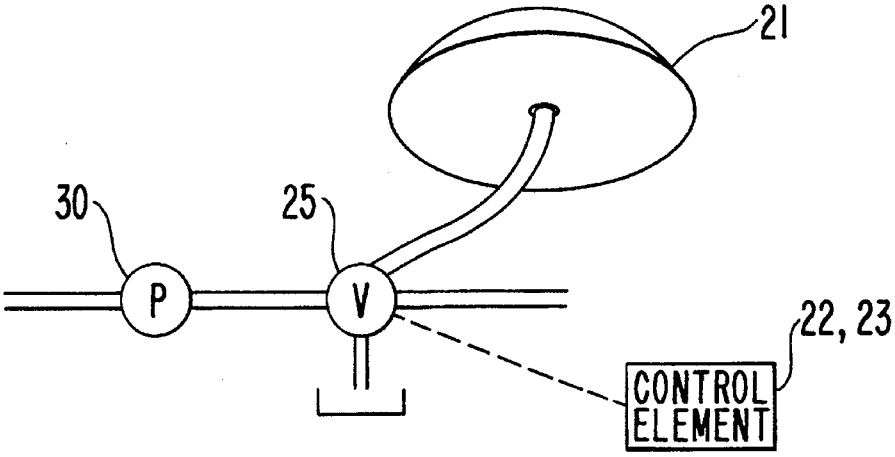
FIG. 4 is a schematic diagram of that portion of the bathtub associated with the control element for inflating and deflating a cushion of the tub.

The inflatable cushion may be inflated with either compressed air or water at an adequate pressure. Such fluids under pressure may be derived from either the water circulation pump 30 or the "blower" of the tub as shown in FIG. 4.

Furthermore, in the case of a conventional bathtub, the pressure required to inflate the cushion may be directly derived from the water delivery pressure in the mains.

Figure 5A:
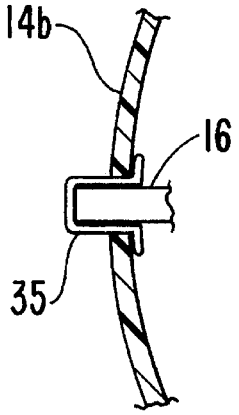
FIGS. 5*a* and 5*b* are schematic sectional views of portions of the handles of the tub showing a water-tight sealing of control elements mounted to handles of the tub.
Figure 5B:
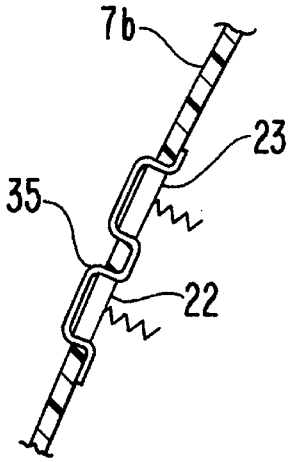

All of the above-mentioned control and actuation elements are water-tight so as to prevent water possibly seeping therethrough from damaging functional elements located thereunder. To this end, those control and actuation elements which are in the form of knobs or push-buttons are covered by an elastic membrane which is sealed in a water-tight manner with any known technique along the entire opening in the handle through which each element protrudes. Examples of this feature as applied to push-button 16 and elements 22 and 23 are shown in FIGS. 5*a* and 5*b*, respectively, the elastic membranes being designated by reference numeral 35.

It should be clear from the description above that the present invention possesses the following advantages:

a) facilitating a rapid assembly of the various control and actuation elements and the associated water delivery elements of the tub;

b) ease in mounting the control and actuation elements to the tub handles which, therefore, can be pre-assembled and not necessarily assembled during the installation of the tub;

c) improved water-tight sealing of various ones of the control and actuation elements;

d) provision of an easily and conveniently inflatable cushion;

e) ergonomic arrangement of the control, actuation and water delivery elements, compatible with the support handles;

f) overall manufacturing and installation cost-effectiveness utilizing known, simple and reliable techniques.

It will be appreciated that various changes and modifications will become apparent to those of ordinary skill in the art without departing from the spirit and scope of the invention as defined by the appended claims.

What is claimed is:

1. A bathtub comprising a tub body having two opposing longitudinally extending sides each having an upper edge, and two shorter sides; tub accessory elements; a pair of handles for use in aiding one into and out of the tub body, said handles being mounted to the tub body at the upper edges of said longitudinally extending sides thereof, respectively, each of said handles having a first narrow portion to be grasped by the hand of a user; and an integral second portion in the form of a housing having a wider profile than that of said first narrow portion; and tub operation elements mounted to the housings of said handles for providing actuation of said tub accessory elements.

2. A bathtub as claimed in claim 1, and further comprising an inflatable cushion mounted to one of said shorter sides of the tub, at least one fluid line extending through said tub body to said cushion and by which line fluid is selectively admittable to and dischargeable from said cushion, and a control element operatable to selectively cause fluid to be admitted to and discharged from said cushion through said line, and where a switch is operatively coupled to said control element.

3. A bathtub as claimed in claim 2, wherein said switch comprises one of said tub operation elements.

4. A bathtub as claimed in claim 3, wherein said switch protrudes from said housing and further comprising a water-tight seal provided between said switch and said housing.

5. A bathtub as claimed in claim 1, wherein at least one of said tub operation elements protrudes from said housing, and further comprising a water-tight seal provided between said at least one of said tub operation elements and said housing.

6. A bathtub as claimed in claim 1, wherein one of the housings of said handles has a water outlet in a lower portion thereof opening into the tub body.

7. A bathtub as claimed in claim 6, wherein said one of the handles has a series of ridges below said water outlet such that water flowing out of said outlet will cascade over said ridges and into said tub body.

8. A bathtub as claimed in claim 1, and further comprising a water circulation circuit open to said tub body, a water circulating pump connected in-line with said circuit so as to circulate water through the tub body via said circuit, a liquid disinfectant reservoir connected to said water circulation circuit, and a control element interposed between said reservoir and said water circulation circuit, said control element being actuatable to admit disinfectant from said reservoir into said water circulation circuit so that a disinfecting operation is carried out, and wherein one of said tub operation elements includes an actuator operatively connected to said control element so as to actuate the same and initiate the disinfecting operation.

9. A bathtub as claimed in claim 8, wherein said actuator includes a lock mounted to one of said handles, and a key for said lock.

10. A bathtub as claimed in claim 9, wherein said lock is a magnetic lock, and said key is a magnetic key.

* * * * *